US006217411B1

(12) United States Patent
Hiyama et al.

(10) Patent No.: US 6,217,411 B1
(45) Date of Patent: Apr. 17, 2001

(54) POLISHING APPARATUS

(75) Inventors: Hirokuni Hiyama, Tokyo; Yutaka Wada, Kanagawa-ken; Kazuto Hirokawa, Kanagawa-ken; Hisanori Matsuo, Kanagawa-ken, all of (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/276,922

(22) Filed: Mar. 26, 1999

(30) Foreign Application Priority Data

Mar. 27, 1998 (JP) ..... 10-099991

(51) Int. Cl.[7] ..... B24B 49/00; B24B 7/22

(52) U.S. Cl. ..... 451/8; 451/24; 451/398; 451/288

(58) Field of Search ..... 451/398, 405, 451/288, 287, 24

(56) References Cited

U.S. PATENT DOCUMENTS 5,738,568 * 4/1998 Jurjevic ..... 451/41
5,743,784 * 4/1998 Birang et al. ..... 451/21
5,916,009 * 6/1999 Izumi et al. ..... 451/5
5,938,884 * 8/1999 Hoshizaki et al. ..... 156/345
5,975,998 * 11/1999 Olmstead ..... 451/288
6,019,868 * 2/2000 Kimura et al. ..... 156/345
6,027,401 * 2/2000 Saito et al. ..... 451/398

* cited by examiner

*Primary Examiner*—W. Donald Bray
(74) *Attorney, Agent, or Firm*—Wenderoth, Lind & Ponack, L.L.P.

(57) ABSTRACT

A polishing apparatus includes a rotatable polishing pad having a polishing surface, a carrier for carrying an article to be polished and a support for stationarily supporting the carrier in such a manner that the article carried by the carrier is engaged with the polishing surface. A universal joint is provided between the carrier and the support. A sensor device senses a friction force generated between the article and the polishing surface as the polishing pad is rotated and imposed on the carrier. A pressing device has a plurality of pushers arranged around the joint to apply pressures to the carrier towards the polishing pad. A control unit determines magnitudes of pressures applied to the carrier by the respective pushers on the basis of the friction force sensed by the sensor device so that a total pressure applied to the carrier against the flat polishing surface including the pressures applied by the pushers compensates an angular moment acting on the carrier about the joint which is generated by the friction force acting between the article and the flat polishing surface.

11 Claims, 4 Drawing Sheets

POLISHING APPARATUS

BACKGROUND OF THE INVENTION

The present invention relates to a polishing apparatus, in particular, a semiconductor wafer polishing apparatus.

A typical semiconductor wafer polishing apparatus includes, as shown in FIG. 6, a polishing pad 3 provided on an upper surface of a turn table (not shown), a wafer carrier 2 for carrying a wafer 1 to be polished and a shaft-like support 4 connected to the carrier 2 at the lower end thereof through a universal joint 5. The support 4 is adapted to be drivingly rotated around its axis by means of a motor (not shown) connected to the support and the universal joint 5 is adapted to transmit a rotational torque from the support to the carrier 2 to rotate the carrier about its axis while allowing the carrier 2 to pivot about the universal joint 5.

In operation, the turn table with the polishing pad 3 is drivingly rotated and the support 4 is positioned so that the wafer 1 carried by carrier 2 is brought into contact with a flat polishing surface 3' of the polishing pad 3 with a degree of pressure F, with the support 4 being simultaneously drivingly rotated, whereby the surface of the wafer 1 contacting the polishing surface of the polishing pad is polished.

Accordingly, a friction force f between the polishing pad and the wafer causes an angular moment M which acts on the carrier 2 with the wafer 1 about the universal joint 5 or the connecting point between the carrier 2 and the support 4, whereby the carrier with the wafer tilts about the universal joint 5 thereby causing an unevenness or gradient in a pressure generated between the contacting surfaces of the wafer and the polishing pad. This causes a deterioration in quality of the polishing operation.

SUMMARY OF THE INVENTION

An object of the present invention is therefore to provide a polishing apparatus which solves the problem discussed above.

In accordance with the present invention, a polishing apparatus comprises a polishing member having a polishing surface, a carrier for carrying an article to be polished, a support for supporting the carrier in such a manner that the article carried by the carrier Is engaged with the polishing surface, the carrier and the polishing pad being adapted to be moved relative to each other in such a manner that the article carried by the carrier is moved relative to and on the polishing surface of the polishing pad, a sensor device for sensing a friction force generated between the article and the polishing surface and imposed on the carrier due to the relative movement of the article on the polishing surface, a pressing device operatively associated with the carrier to impose a counter angular moment against a angular moment on the carrier by applying a pressure to at least one point on the carrier towards the polishing surface to generate the counter angular moment, and a control unit for determining a magnitude of the pressure applied to the above-noted at least one point on the carrier on the basis of the friction force sensed by the sensor device so that the angular moment is compensated by the counter angular moment.

The above features and advantages of the present invention will be become apparent from the following description and the appended claims taken in conjunction with the accompanying drawings.

DETAILED DESCRIPTION OF THE INVENTION

Figure 1:
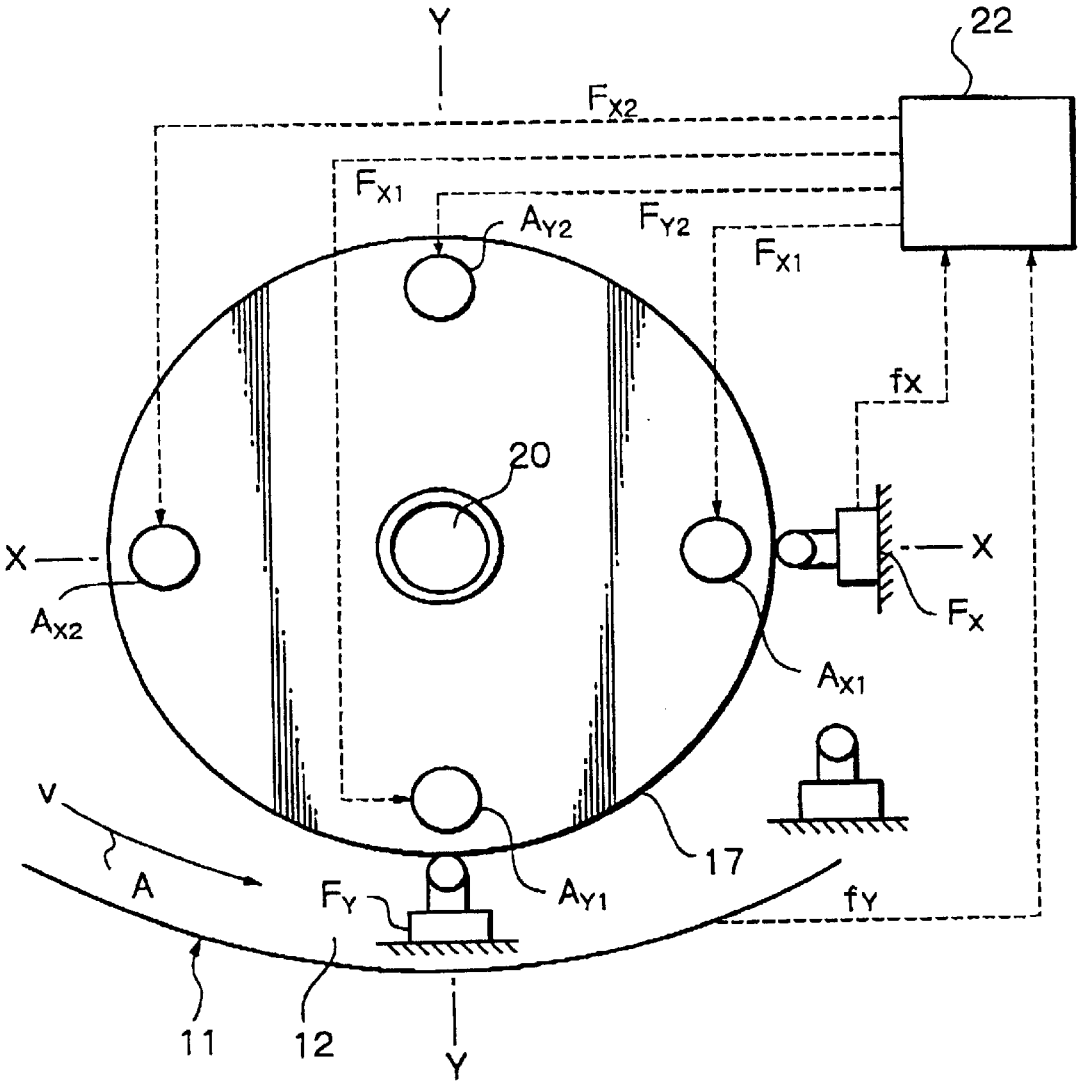
FIG. 1 is a schematic plan view of a part of a polishing apparatus in accordance with a first embodiment of this invention showing a positional arrangement of major elements thereof.
Figure 2:
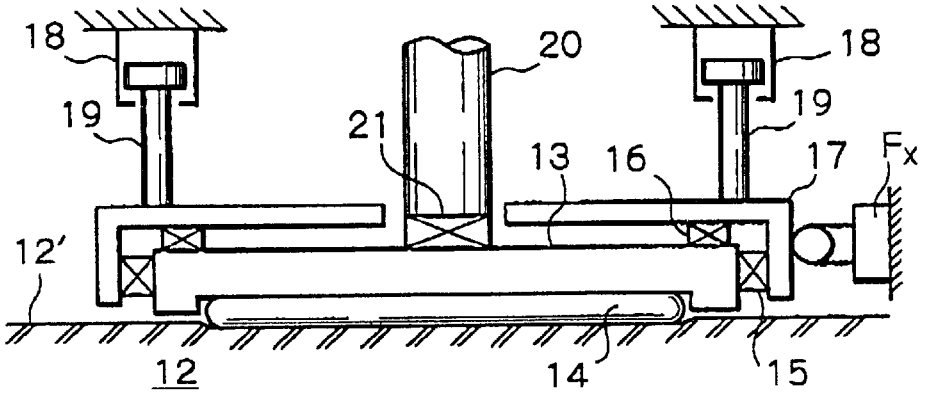
FIG. 2 is a view taken along a line X—X in FIG. 1.

Referring to FIGS. 1 and 2, there is shown a polishing apparatus in accordance with the first embodiment of this invention which includes a turn table 11, a polishing pad 12 provided over the upper surf ace of the turn table 11, a carrier 13 for carrying an article such as a semiconductor wafer 14 to be polished, and a shaft-like support 20 pivotably connected to the carrier 13 by means of a universal joint 21. The carrier is in the form of a circular disc having a recess for receiving and carrying the article 14. The support 20 is connected to the center of the upper surface of the carrier 13. The support 20 is drivingly connected to a motor (not shown) to be rotated around its axis. The universal joint 21 is adapted to transmit a rotational torque applied to the support by the motor to the carrier 13 to rotate the carrier 13 around its axis while allowing the carrier 13 to pivot about the universal joint 21.

In this embodiment, the polishing apparatus further includes a pressing device which comprises a circular press cover 17 provided on the carrier 13 through bearings 15, 16 which enable the carrier 13 to rotate about its axis independently of the circular press cover 17 and four piston-cylinder type pushers Ax1, Ay1, Ax2, Ay2 arranged along the circular periphery of the press cover 17 at the three o'clock, six o'clock, nine o'clock and twelve o'clock positions on the cover 17 as viewed in FIG. 1, respectively. Each of the pushers Ax1, Ay1, Ax2, Ay2 includes a cylinder 18 fixed to a stationary frame and a piston-rod 19 the lower end of which is securely connected to the upper surface of the carrier 17. The piston-rod 19 is adapted to be extruded from the cylinder 18 with a pressure imposed on the piston installed in the cylinder 18 by a fluid supplied into the cylinder 18. The pressing device further includes pressure sensors Fx and Fy which are fixed on a stationary frame in such a manner that the sensors are nearly in contact with the outer circumferential surface of the press cover 17 at the three o'clock and six o'clock positions of the press cover as viewed in FIG. 1, respectively. The pushers Ax1, Ay1, Ax2, Ay2 and the support 20 are arranged so that they allow the carrier 13 with the article 14 and the press cover 17 to move slightly horizontally so that when turn table is rotated, the carrier 13 and the press cover 17 are moved towards and press the sensors Fx and Fy. The pressure sensors Fx and Fy include rotatable balls at the tip ends thereof as contact elements with the outer periphery of the press cover 17 to enable the pressure sensors Fx and Fy to sense only horizontal forces transmitted from the press cover 17 in the directions of the lines X—X and X–Y in FIG. 1, respectively, without any angular moments.

Furthermore, the pressing device includes a control unit or arithmetic and control unit 22 which receives signals designating values of the pressures or the horizontal forces sensed by the sensors Fx and Fy to determine or compute values Fx1, Fy1, Fx2 and Fy2 of pressures which, as explained below, are imposed on the piston-rods 19 of the pushers Ax1, Ay1, Ax2, Ay2, respectively, and thus on the press cover 17.

Figure 3:
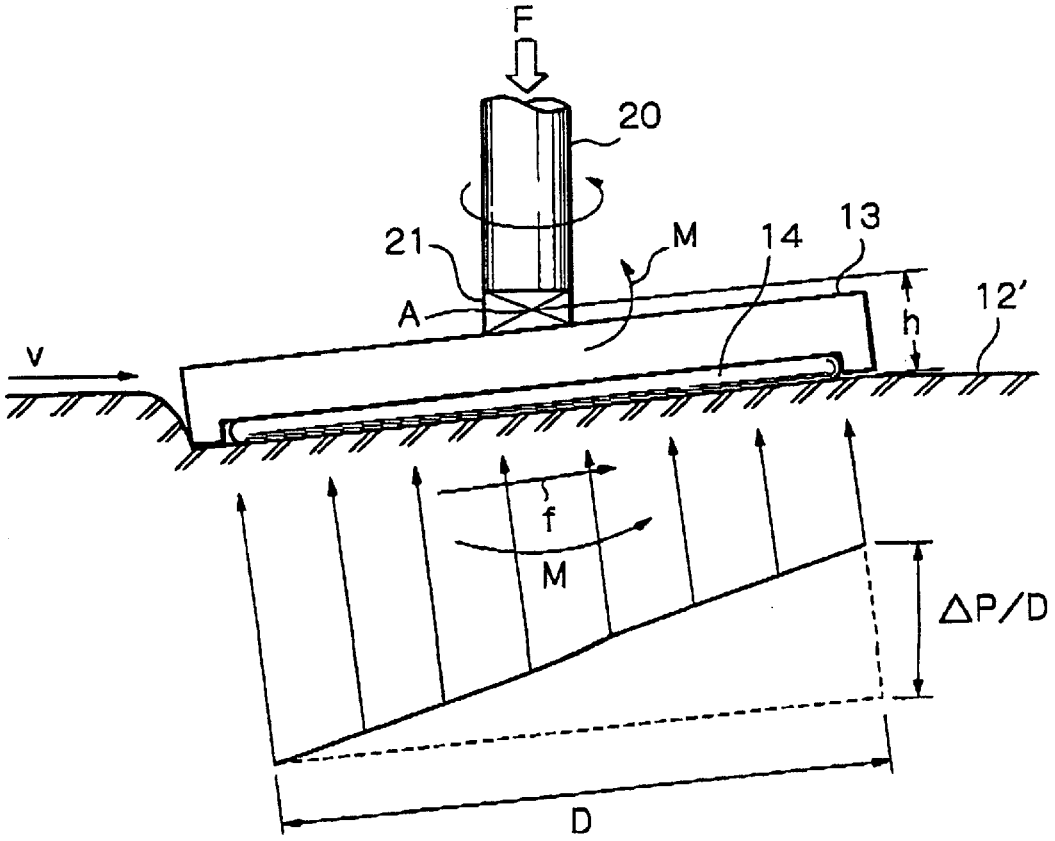
FIG. 3 is a view similar to FIG. 2 showing an influence of an angular moment imposed on a carrier for carrying an article to be polished.

In operation, upon rotation of the turn table 11 in the direction as designated by an arrow v in FIG. 1, the carrier 13 and the press cover 17 are moved towards and urged against the pressure sensors Fx and Fy by a friction force f generated between the article 14 and the flat surface 12' of the polishing pad 12. Then, the sensors Fx and Fy sense pressures imposed thereon by the press cover 17 which are X-directional and Y-directional components of the friction force f. The friction force f acts on the article to thereby tilt or pivot the article 14, the carrier 13 and the press cover 17 as a unit about the universal joint 21 as shown in FIG. 3.

Figure 4:
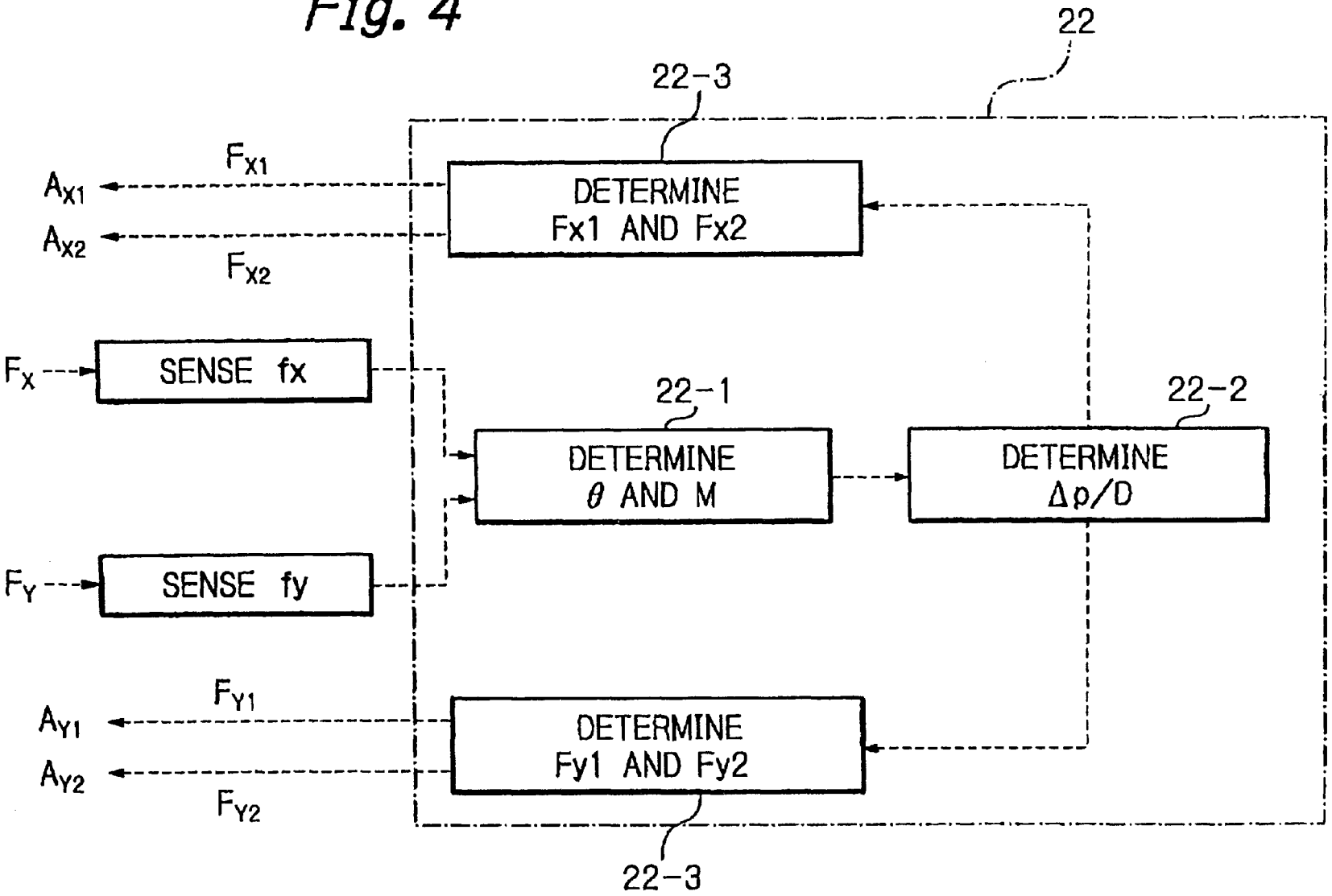
FIG. 4 is a block-diagram of an arithmetical and control unit for controlling a pressing device for applying pressures on a carrier towards a polishing surface in a polishing apparatus shown in FIG. 1.

The sensors Fx and Fy sense the components of the friction force f as pressures and transmit signals representing magnitudes of those components to the control unit 22. As shown in FIG. 4, the control unit determines on the basis of the signals a direction θ of the friction force f and an angular moment M caused by the frictional force f which is calculated from a formula, i.e., M=fh in which h means the distance between the article surface contacting with the polishing pad 12 and the pivotal center A of the universal joint 21 (22-1). Further, the control unit 22 determines a pressure gradient Δp/D in the direction of the friction force f across the article surface contacting with the polishing pad 12 on the basis of the direction θ of the friction force f and the angular moment M (22-2). In the above, "Δp" is a difference between the maximum and minimum pressures imposed on the article from the polishing surface in contact with the article surface and "D" is a diameter of the article. Finally, the control unit 22 determines pressures Fx1, Fx2, Fy1,Fy2 (22-3; 22-3) which the pushers Ax1, Ay1, Ax2, Ay2 should impose on the press cover 17 to compensate the angular moment thereby making the press cover 17, the carrier 13 and thus the article surface to be horizontal. This makes it possible for the article surface to be uniformly polished.

Figure 5:
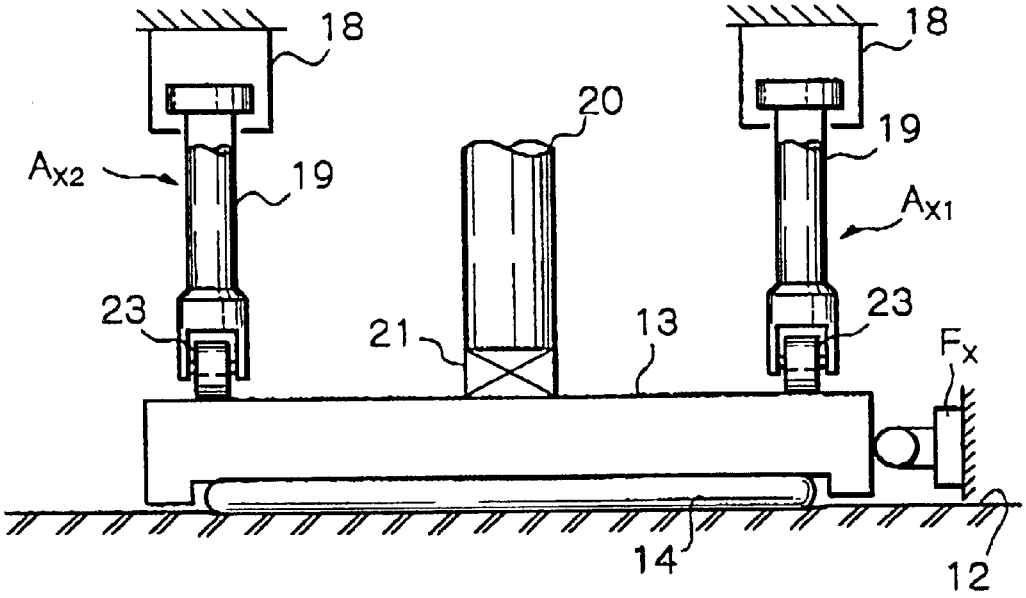
FIG. 5 is a view similar to FIG. 2 showing a polishing apparatus in accordance with an other embodiment of this invention.
Figure 6:
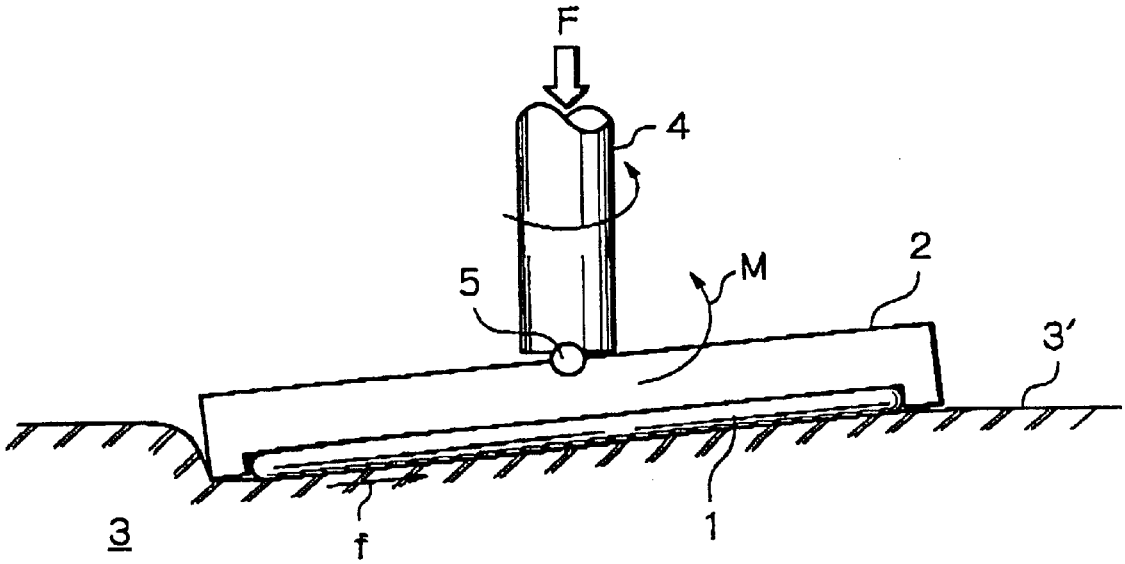
Fig. 6 PRIOR ART
FIG. 6 is a view similar to FIG. 3 showing a relationship between a carrier and a polishing pad in a prior art polishing apparatus in operation.

FIG. 5 shows a polishing apparatus in accordance with the second embodiment of this invention. The polishing apparatus does not include a press cover as in the first embodiment. Instead, the lower ends of the piston-rods 19 of the pushers are provided with rollers 23 which are rotatably engaged with the upper surface of the carrier 13 so that the carrier can rotate independently of the pushers.

While the invention is susceptible to various modifications and alternative forms, specific embodiments thereof have been shown by way of example and were herein described in detail. It should be understood, however, that it is not intended to limit the invention to the particular forms disclosed, but on the contrary, the intention is to cover all modifications, equivalents and alternatives falling within the spirit and scope of the invention as defined by the appended claims.

What is claimed is:

1. A polishing apparatus comprising:

a polishing member having a polishing surface;

a carrier to carry an article to be polished;

a support supporting said carrier for rotation about said support in a manner such that the article carried by said carrier is engaged with said polishing surface;

said carrier and said polishing member being movable relative to each other in a manner such that the article carried by said carrier is moved relative to and on said polishing member, during which a friction force is generated between the article and said polishing surface, thus generating an angular moment acting on said carrier;

a sensor device to sense said friction force;

a pressing device to apply a pressure to said carrier and thereby to generate a counter angular moment acting against said angular moment; and a control unit to determine a magnitude of said pressure applied to said carrier as a function of said friction force sensed by said sensor device to provide that said counter angular moment compensates said angular moment.

2. An apparatus as claimed in claim 1, wherein said pressing device applies pressures at a plurality of positions on said carrier toward said polishing surface to generate said counter angular moment, and said control unit determines magnitudes of pressures at respective said positions as a function of said friction force sensed by said sensor device to provide that said counter angular moment compensates said angular moment.

3. An apparatus as claimed in claim 2, wherein said pressing device comprises a plurality of pushers located at said positions to apply respective said pressures to said carrier at said positions toward said polishing surface.

4. An apparatus as claimed in claim 3, wherein said polishing member comprises a turn table and a polishing pad thereon and defining said polishing surface, said turn table and said polishing pad being rotatable together about an axis of said turn table.

5. An apparatus as claimed in claim 4, wherein said carrier comprises a circular disc, and said pressing device further comprises a press cover on said circular disc, and bearings between said press cover and said circular disc to enable said carrier to rotate about an axis thereof independently of said press cover, said pushers acting on said press cover to impose said respective pressures to said circular disc through said press cover.

6. An apparatus as claimed in claim 5, further comprising a stationary frame, and wherein said sensor device includes at least one pressure sensor mounted on said stationary frame adjacent to and radially outwardly of said press cover at a position such that, as said turn table and said polishing pad rotate together about said axis of said turn table, said carrier carrying the article and said press cover are subjected to said friction force and thus are caused to be moved toward and into engagement with said pressure sensor, whereby said pressure sensor senses said friction force, and said control unit determines said magnitudes of said respective pressures applied to said press cover as a function of said friction force sensed by said pressure sensor.

7. An apparatus as claimed in claim 6, wherein said at least one pressure sensor comprises two pressure sensors, spaced from each other in a circumferential direction of said press cover, to sense respectively an X-component of said friction force and a Y-component of said friction force, and said control unit derives said friction force from said components.

8. An apparatus as claimed in claim 4, wherein said carrier comprises a circular disc rotatable about an axis thereof, and said pushers have rolling elements engaging said carrier, such that said pushers apply said respective pressures through said rolling elements, and said rolling elements enable said carrier to rotate about said axis thereof independently of said pushers.

9. An apparatus as claimed in claim 8, further comprising a stationary frame, and wherein said sensor device includes at least one pressure sensor mounted on said stationary frame adjacent to and radially outwardly of said carrier at a position such that, as said turn table and said polishing pad rotate together about said axis of said turn table, said carrier carrying the article subjected to said friction force and thus is caused to be moved toward and into engagement with said pressure sensor, whereby said pressure sensor senses said friction force, and said control unit determines said magnitudes of said respective pressures applied to said carrier as a function of said friction force sensed by said pressure sensor.

10. An apparatus as claimed in claim 9, wherein said at least one pressure sensor comprises two pressure sensors, spaced from each other in a circumferential direction of said carrier, to sense respectively an X-component of said friction force and a Y-component of said friction force, and said control unit derives said friction force from said components.

11. An apparatus as claimed in claim 1, further comprising a joint connecting said carrier to said support, said angular moment acting on said support around said joint, said pressing device comprises a plurality of pushers located around said joint at said positions to apply respective said pressures to said carrier toward said polishing surface.

* * * * *